US005365637A

United States Patent [19]

Bodell et al.

[11] Patent Number: 5,365,637

[45] Date of Patent: Nov. 22, 1994

[54] FLEX HANDLE FOR A POWER TOOL

[75] Inventors: Steven W. Bodell; Robert R. Kimberlin, both of Troutville, Va.

[73] Assignee: Ingersoll-Rand Company, Woodcliff Lake, N.J.

[21] Appl. No.: 77,829

[22] Filed: Jun. 15, 1993

[51] Int. Cl.[5] ..... B25D 17/04; B25G 1/02

[52] U.S. Cl. ..... 16/116 R; 173/162.2

[58] Field of Search ..... 16/111 R, 116 R, DIG. 12, 16/110 R; 81/177.1, 489; 173/162.2, 170

[56] References Cited

U.S. PATENT DOCUMENTS

| | | | |
|---|---|---|---|
| 786,050 | 3/1905 | Richwood . | |
| 2,134,863 | 11/1938 | Dvorak . | |
| 2,830,463 | 4/1958 | Irgens . | |
| 4,368,556 | 1/1983 | Wanner et al. . | |
| 4,381,579 | 5/1983 | Rumpp | 16/DIG. 12 |
| 4,648,468 | 3/1987 | Honsa . | |
| 4,949,457 | 8/1990 | Burout, III . | |
| 5,052,500 | 10/1991 | Ohtsu | 173/162.2 |
| 5,054,562 | 10/1991 | Honsa et al. . | |
| 5,157,807 | 10/1992 | Keller et al. | 16/116 R |
| 5,273,120 | 12/1993 | Chang | 16/116 R |

FOREIGN PATENT DOCUMENTS

| | | | |
|---|---|---|---|
| 490850 | 6/1992 | European Pat. Off. . | |
| 55630 | 5/1967 | Germany . | |
| 2804223 | 8/1979 | Germany | 16/116 R |
| 2080919 | 2/1982 | United Kingdom | 173/162.2 |
| 2138348 | 10/1984 | United Kingdom | 173/162.2 |

*Primary Examiner*—Lowell A. Larson
*Assistant Examiner*—Donald M. Gurley
*Attorney, Agent, or Firm*—John J. Selko

[57] ABSTRACT

A vibration absorbing handle for a power tool includes a monolithic, elastomeric outer gripping member having affixed and extending therein an elongated, hollow support member and a first mounting member for connection to a tool housing, the outer gripping member forming an annular flange between the hollow support member and the mounting member, the flange and outer gripping member providing flexibility and vibration absorption.

6 Claims, 1 Drawing Sheet

FLEX HANDLE FOR A POWER TOOL

BACKGROUND OF THE INVENTION

This invention relates generally to vibration absorbing handles for percussive power tools such as pavement breakers, and more particularly to vibration absorbing handles that permit slight flexing by the operator during use, while simultaneously absorbing operational vibration.

Current handles prevent vibration in a direction along the axis of length of the handle. However, vibration in pavement breakers is usually in a direction that is transverse to, or across, the axis of the handle length.

The foregoing illustrates limitations known to exist in present handles. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a vibration absorbing handle for a power tool comprising: (a) an elongated gripping member having a longitudinal axis of symmetry, a first end, a second end, and an inner bore coaxial with said axis, said bore forming an opening at said first end and extending substantially the length of said gripping member; (b) an elongated, hollow tubular support member affixed in said bore, extending coaxially along said axis, said support member having an inner end adjacent said first end of said gripping member and an outer end adjacent said second end of said gripping member; (c) a first mounting means for connecting said gripping member to a power tool, said mounting means affixed in said bore, at said first end of said gripping member, said mounting means extending coaxially along said axis, said mounting means being spaced from said inner end of said support member; and (d) said gripping member being a monolithic elastomeric body covering said support member and said first mounting means, said gripping member forming a flexible flange in said bore, said flange extending radially with respect to said axis and said flange positioned between, and in contact with said support member and said first mounting means.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
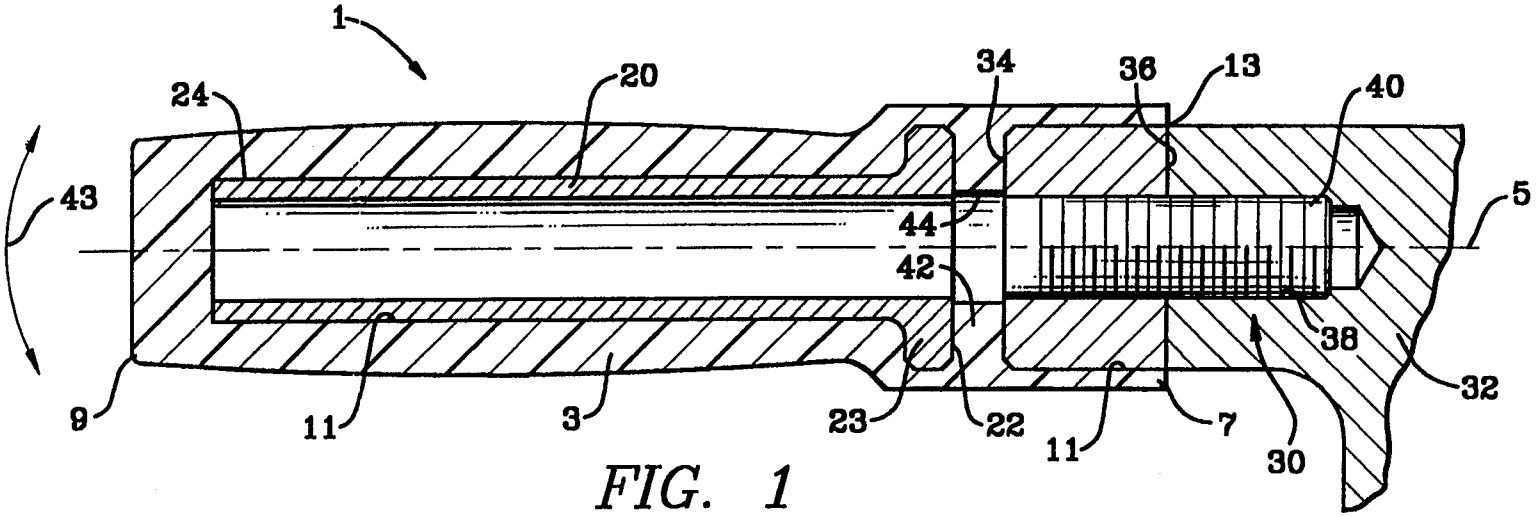
FIG. 1 is a longitudinal cross section through a handle of the invention.

Now referring to FIG. 1, there is shown a vibration absorbing handle 1 for a percussive power tool. One handle 1 is shown, but as is well known, a pair of oppositely extending handles 1 is provided on percussive power tools. A description of one handle 1 applies for both handles. Handle 1 comprises an elongated gripping member 3 having a longitudinal axis of symmetry 5, a first end 7, a second end 9 and an inner bore 11 coaxial with axis 5. Bore 11 has varying internal diameters.

Bore 11 forms an opening 13 at first end 7 and extends substantially the length of gripping member 3. We prefer bore 11 to terminate inside member 3, but it could extend all the way through to form a second opening at second end 9. A closure cap at this second opening would be optional.

An elongated, hollow tubular support member 20 is affixed inside bore 11, and extends coaxially along axis 5. Support member 20 is a hollow bushing having an inner end 22 adjacent first end 7 of gripping member 3 and an outer end 24 adjacent second end 9 of member 3. Inner end 22 forms an annular flange 23 extending radially in relation to axis 5.

A first mounting means 30 for connecting gripping member 3 to a power tool housing 32 is affixed in bore 11 at first end 7 of gripping member 3. First mounting means 30 is a hollow bushing having a bore therethrough, and extends coaxially along axis 5. First mounting means 30 has a first end 34 spaced from inner end 22 of support member 20 and a second end 36 adapted to contact against a housing 32. First mounting means 30 has threads 38 on an internal surface forming the bore. Threads 38 connect handle 1 to a threaded mounting stud 40 fastened to housing 32.

Gripping member 3 is a monolithic, elastomeric body externally covering support member 20, and first mounting means 30, and extending into and filling space 42 between first mounting means 30 and support member 20. Gripping member 3 contacts both first mounting means 30 and support member 20 in space 42, and forms a flexible annular flange 44 in bore 11 between first mounting means 30 and support member 20. Flange 44 is part of elastomeric body 3, has its own bore coaxial with axis 5, and extends radially inward in bore 11 in relation to axis 5. Flange 44 permits handle 1 to flex in a direction generally transverse, or across axis 5, as indicated by arrows 43, in response to force applied to the handle by an operator, or from vibration of the tool. Flange 44 also permits simultaneous slight flexing of handle 1 in a direction along axis 5. With flange 44 separating first mounting means 30 and support member 20, and with the combination of flange 44 and elastomeric member 3, vibration is very effectively absorbed.

We prefer to make handle 1 a single member by forming member 3 around first mounting means 30 and support member 20. Handle 1 can then be easily threaded onto stud 38. We prefer to provide gripping member 3 from an elastomeric material that is an oil-resistant, general purpose neoprene.

Figure 2:
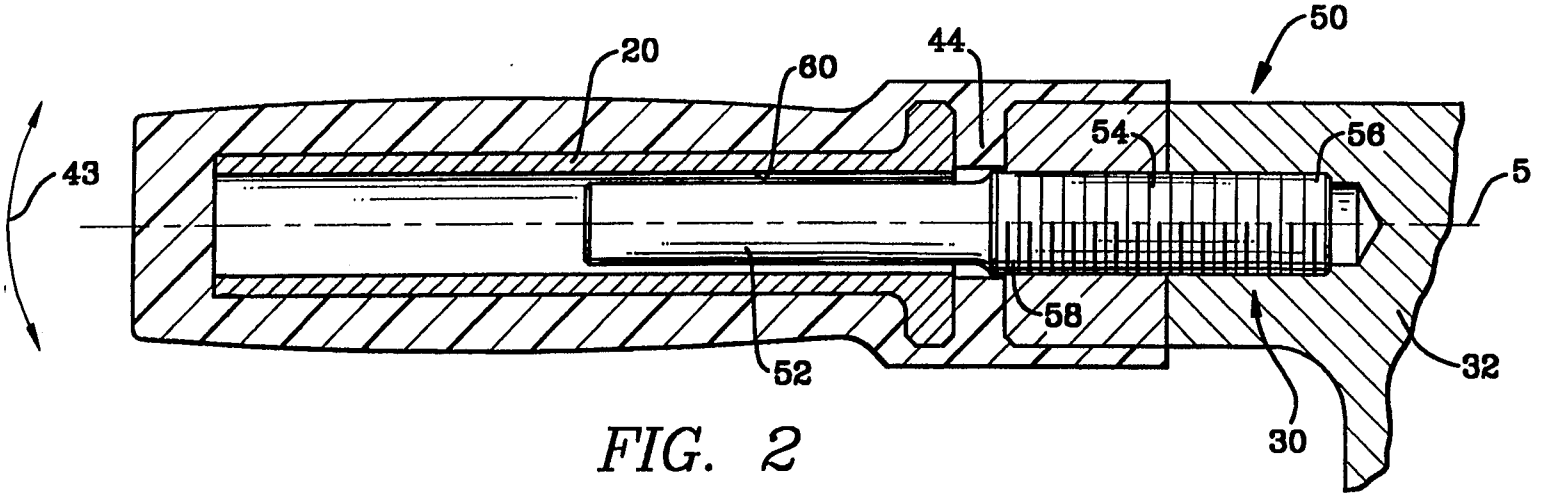
FIG. 2 is a longitudinal cross section through an alternate embodiment handle of the invention.

Now referring to FIG. 2 an alternate embodiment is shown wherein handle 1 further includes a second mounting means 50 for connecting first mounting means 30 to housing 32. Second mounting means 50 is an elongated support stud 52 telescoped within first mounting means 30 and support member 20. Stud 52 has a threaded portion 54 connected at a first end 56 to housing 32, in a fashion similar to that used for stud 38. Threaded portion 54 extends over a portion of the length of stud 52, and is connected at a second end 58 to first mounting means 30. Stud 52 extends axially along axis 5 from threaded portion 54 substantially the length of support member 20. Stud 52 is spaced from an inner wall 60 of support means 20 a sufficient distance to permit a slight flex in handle gripping member 3 at flange 40 in response to pressure from an operator. After flange 40 and gripping member 3 flex a slight amount, stud 52 contacts support member 20 to provide added structural support to gripping member 3.

Having described the invention, what is claimed is:

1. A vibration absorbing handle for a power tool comprising:

(a) an elongated gripping member having a longitudinal axis of symmetry, a first end, a second end, and an inner bore coaxial with said axis, said bore forming an opening at said first end and extending substantially the length of said gripping member;

(b) an elongated, hollow tubular support member affixed in said bore, extending coaxially along said axis, said support member having an inner end adjacent said first end of said gripping member and an outer end adjacent said second end of said gripping member;

(c) a first mounting means for connecting said gripping member to a power tool, said mounting means affixed in said bore, at said first end of said gripping member, said mounting means extending coaxially along said axis, said mounting means being spaced from said inner end of said support member; and (d) said gripping member being a monolithic elastomeric body covering said support member and said first mounting means, said gripping member forming a flexible flange in said bore, said flange extending radially with respect to said axis and said flange positioned between, and in contact with said support member and said first mounting means.

2. The handle of claim 1 further including a second mounting means for connecting said first mounting means to said housing, said second mounting means being an elongated support stud, connected at one end to said housing and connected at a second end to said first mounting means, said support stud extending axially along said axis a substantial length of said support member.

3. The handle of claim 2 wherein said stud is spaced from an inner wall of said tubular support means a sufficient distance to permit a slight flex in the handle gripping member before contacting said support means.

4. The handle of claim 3 wherein said stud is threadably connected to said housing.

5. The handle of claim 4 wherein said stud is threadably connected to said first mounting means.

6. A vibration absorbing handle for a power tool comprising:

(a) an elongated gripping member having a longitudinal axis of symmetry, a first end, a second end, and an inner bore coaxial with said axis, said bore forming an opening at said first end and extending substantially the length of said gripping member;

(b) an elongated, hollow tubular support member affixed in said bore, extending coaxially along said axis, said support member having an inner end adjacent said first end of said gripping member and an outer end adjacent said second end of said gripping member;

(c) a first mounting means for connecting said gripping member to a power tool, said mounting means affixed in said bore, at said first end of said gripping member, said mounting means extending coaxially along said axis, said mounting means being spaced from said inner end of said support member;

(d) said gripping member being a monolithic elastomeric body covering said support member and said first mounting means, said gripping member forming a flexible flange in said bore, said flange extending radially with respect to said axis and said flange positioned between, and in contact with said support member and said first mounting means; and (e) second mounting means for connecting said first mounting means to said housing, said second mounting means being an elongated support stud, connected at one end to said housing and connected at a second end to said first mounting means, said support stud extending axially along said axis a substantial length of said support member.

* * * * *